US011192159B2

(12) United States Patent
Gaensbauer et al.

(10) Patent No.: US 11,192,159 B2
(45) Date of Patent: Dec. 7, 2021

(54) SYSTEMS AND METHODS FOR QUENCHING A METAL STRIP AFTER ROLLING

(71) Applicant: Novelis Inc., Atlanta, GA (US)

(72) Inventors: David Anthony Gaensbauer, Atlanta, GA (US); Andrew James Hobbis, Bath (CA)

(73) Assignee: Novelis Inc., Atlanta, GA (US)

( * ) Notice: Subject to any disclaimer, the term of this patent is extended or adjusted under 35 U.S.C. 154(b) by 143 days.

(21) Appl. No.: 16/440,256

(22) Filed: Jun. 13, 2019

(65) Prior Publication Data

US 2019/0381549 A1 Dec. 19, 2019

Related U.S. Application Data

(60) Provisional application No. 62/684,428, filed on Jun. 13, 2018.

(51) Int. Cl.
*B21B 38/02* (2006.01)
*B21B 45/02* (2006.01)

(52) U.S. Cl.
CPC ..... *B21B 45/0233* (2013.01); *B21B 45/0218* (2013.01); *B21B 38/02* (2013.01); *B21B 2261/21* (2013.01); *B21B 2263/04* (2013.01)

(58) Field of Classification Search
CPC ..... B21B 37/44; B21B 37/76; B21B 38/006; B21B 38/02; B21B 45/0218; B21B 45/0233; B21B 2261/20; B21B 2263/04; B21B 37/74; B21B 37/28; C21D 1/667; C21D 8/0263; C21D 8/0294
See application file for complete search history.

(56) References Cited

U.S. PATENT DOCUMENTS 3,262,822 A * 7/1966 Griffith ..... C22F 1/04 148/688
3,533,261 A * 10/1970 Van Loon ..... C21D 1/667 72/201

(Continued)

FOREIGN PATENT DOCUMENTS

EP 2617840 A2 7/2013
RU 2562565 C2 9/2015

(Continued)

OTHER PUBLICATIONS

International Patent Application No. PCT/US2019/036962 , International Preliminary Report on Patentability, dated Dec. 24, 2020, 7 pages.

(Continued)

*Primary Examiner* — Edward T Tolan
(74) *Attorney, Agent, or Firm* — Kilpatrick Townsend & Stockton LLP

(57) ABSTRACT

Systems and methods of quenching a metal substrate include cooling a top surface and a bottom surface of the metal substrate until a strip temperature is cooled to an intermediate temperature. Cooling of the top surface of the metal substrate is discontinued when the strip temperature reaches the intermediate temperature, and cooling of the bottom surface of the metal substrate continues until the metal substrate reaches a target temperature, where the target temperature is less than the intermediate temperature.

17 Claims, 5 Drawing Sheets

(56) References Cited

U.S. PATENT DOCUMENTS 3,648,996 A * 3/1972 Yonezawa ..... B21B 45/0233 134/68
4,047,985 A * 9/1977 Greenberger ..... B21B 37/76 134/15
4,318,534 A * 3/1982 Thome ..... B21B 45/0233 266/113
4,379,396 A * 4/1983 Hope ..... B21B 37/44 72/8.5
4,440,584 A * 4/1984 Takeshige ..... C21D 9/573 148/503
4,768,363 A * 9/1988 Yamashita ..... C21D 1/00 72/8.5
4,785,646 A * 11/1988 Uekaji ..... B21B 37/44 72/201
4,899,547 A * 2/1990 Irwin ..... B21B 37/76 62/216
5,724,842 A 3/1998 Beattie et al.
6,301,920 B2 * 10/2001 Matsuda ..... C21D 1/667 266/113
6,776,857 B2 * 8/2004 Lee ..... B21B 45/08 148/601
7,718,018 B2 * 5/2010 Serizawa ..... B21B 37/74 148/661
8,282,747 B2 * 10/2012 Oda ..... C21D 1/667 148/661
9,186,710 B2 * 11/2015 Akashi ..... B21B 37/76
9,364,879 B2 * 6/2016 Shimoi ..... C21D 11/005
9,566,625 B2 * 2/2017 Akashi ..... B21B 45/0218
10,722,929 B2 * 7/2020 Chen ..... C21D 1/667
2009/0049882 A1 * 2/2009 Flick ..... B21B 37/28 72/240
2012/0318478 A1 * 12/2012 Weinzierl ..... B21B 37/76 165/104.11
2014/0250963 A1 9/2014 Nelson et al.
2015/0184266 A1 * 7/2015 Kim ..... C21D 8/0294 148/602
2017/0189949 A1 * 7/2017 Duhoux ..... C21D 1/667
2018/0087138 A1 3/2018 Gaensbauer et al.
2018/0135156 A1 5/2018 Karhausen et al.

FOREIGN PATENT DOCUMENTS

SU 1131461 A3 12/1984
WO 2011104103 A2 9/2011

OTHER PUBLICATIONS

International Patent Application No. PCT/US2019/036962 , International Search Report and Written Opinion, dated Oct. 2, 2019, 12 pages.
Bozhkov et al., "Flatness of Rolled SheetMaterial", SP Internet Engineering, 1998, pp. 224-230.
Russian Patent Application No. 2020132117, Office Action dated May 12, 2021, 20 pages.
Indian Application No. 202017039896 , "First Examination Report", dated Jul. 19, 2021, 7 pages.
Canadian Application No. 3,091,393, Office Action, dated Aug. 30, 2021, 3 pages.
Russian Application No. 2020132117, Office Action, dated Sep. 17, 2021, 9 pages.

* cited by examiner

SYSTEMS AND METHODS FOR QUENCHING A METAL STRIP AFTER ROLLING

REFERENCE TO RELATED APPLICATION

This application claims the benefit of U.S. Provisional Application No. 62/684,428, filed on Jun. 13, 2018 and entitled SYSTEMS AND METHODS FOR QUENCHING A METAL STRIP AFTER ROLLING, the content of which is hereby incorporated by reference in its entirety.

FIELD OF THE INVENTION

This application relates to metal processing and, more particularly, to systems and methods for quenching a metal strip after rolling.

BACKGROUND

During metal processing, rolling may be used to reduce a thickness of a metal substrate (such as stock sheets or strips of aluminum, aluminum alloys, or various other metals) by passing the metal substrate through a pair of work rolls. Depending on the desired properties of the final metal product, the metal stock may be hot rolled, cold rolled, and/or warm rolled. Hot rolling generally refers to a rolling process where the temperature of the metal is above the recrystallization temperature of the metal. Cold rolling generally refers to a rolling process where the temperature of the metal is below the recrystallization temperature of the metal. Warm rolling generally refers to a rolling process where the temperature of the metal is below the recrystallization temperature but above the temperature during cold rolling. However, the properties of the metal (e.g. strength, formability, corrosion resistance, and/or low weight, among others) after rolling may be insufficient for some applications (e.g., automotive, transportation, industrial, and/or electronics-related applications, among others). Therefore, further metal processing of the metal substrate is needed.

SUMMARY

The terms "invention," "the invention," "this invention" and "the present invention" used in this patent are intended to refer broadly to all of the subject matter of this patent and the patent claims below. Statements containing these terms should be understood not to limit the subject matter described herein or to limit the meaning or scope of the patent claims below. Embodiments of the invention covered by this patent are defined by the claims below, not this summary. This summary is a high-level overview of various embodiments of the invention and introduces some of the concepts that are further described in the Detailed Description section below. This summary is not intended to identify key or essential features of the claimed subject matter, nor is it intended to be used in isolation to determine the scope of the claimed subject matter. The subject matter should be understood by reference to appropriate portions of the entire specification of this patent, any or all drawings, and each claim.

According to certain examples, a system for processing a metal substrate, including but not limited to a rolled metal substrate, includes a quenching system. In some examples, the quenching system includes a top nozzle configured to distribute a cooling agent on a top surface of the rolled metal substrate. In various cases, the quenching system includes a bottom nozzle configured to distribute the cooling agent on a bottom surface of the rolled metal substrate. According to various examples, the top nozzle is configured to distribute the cooling agent until a strip temperature of the rolled metal substrate is reduced from an initial temperature to an intermediate temperature that is less than the initial temperature. In certain cases, the bottom nozzle is configured to distribute the cooling agent until the strip temperature of the rolled metal substrate is reduced from the initial temperature to a target temperature that is less than the initial temperature and less than the intermediate temperature.

According to various examples, a method of processing a rolled metal substrate includes cooling a top surface and a bottom surface of the rolled metal substrate with a quenching system such that a strip temperature of the rolled metal substrate is reduced from an initial temperature to an intermediate temperature. In certain cases, the method includes stopping the cooling of the top surface when the strip temperature is the intermediate temperature. In some examples, the method includes continuing cooling the bottom surface of the rolled metal substrate with the quenching system such that the strip temperature of the rolled metal substrate is reduced from the intermediate temperature to a target temperature.

According to certain examples, a system for processing a rolled metal substrate includes a quenching system configured to selectively distribute a cooling agent on the metal substrate in a first quenching configuration and a second quenching configuration. In some aspects, the quenching system cools a top surface and a bottom surface of the metal substrate in the first quenching configuration and cools only the bottom surface of the metal substrate in the second quenching configuration. In certain cases, the system includes a sensor configured to detect a strip temperature of the metal substrate. In various aspects, the quenching system is in the first quenching configuration when the strip temperature is at least an intermediate temperature, and the quenching system is in the second quenching configuration when the strip temperature is reduced from the intermediate temperature to a target temperature that is less than the intermediate temperature.

According to various examples, a method of processing a rolled metal substrate includes detecting a strip temperature of the rolled metal substrate, cooling a top surface and a bottom surface of the rolled metal substrate with a quenching system when the strip temperature is at least an intermediate temperature, and cooling only the bottom surface of the rolled metal substrate with the quenching system when the strip temperature decreases from the intermediate temperature to a target temperature that is less than the intermediate temperature.

According to some examples, a system for processing a rolled metal substrate includes a quenching system. In various cases, the quenching system includes at least one top nozzle configured to distribute a cooling agent on a top surface of the rolled metal substrate and at least two bottom nozzles configured to distribute the cooling agent on a bottom surface of the rolled metal substrate. In some aspects, the quenching system includes a first quench zone that includes the at least one top nozzle and a first bottom nozzle of the at least two bottom nozzles. In various examples, the quenching system includes a second quench zone downstream from the first quench zone and including a second bottom nozzle of the at least two bottom nozzles.

Various implementations described in the present disclosure can include additional systems, methods, features, and advantages, which cannot necessarily be expressly disclosed herein but will be apparent to one of ordinary skill in the art upon examination of the following detailed description and accompanying drawings. It is intended that all such systems, methods, features, and advantages be included within the present disclosure and protected by the accompanying claims.

BRIEF DESCRIPTION OF THE DRAWINGS

The features and components of the following figures are illustrated to emphasize the general principles of the present disclosure. Corresponding features and components throughout the figures can be designated by matching reference characters for the sake of consistency and clarity.

DETAILED DESCRIPTION

Figure 1:
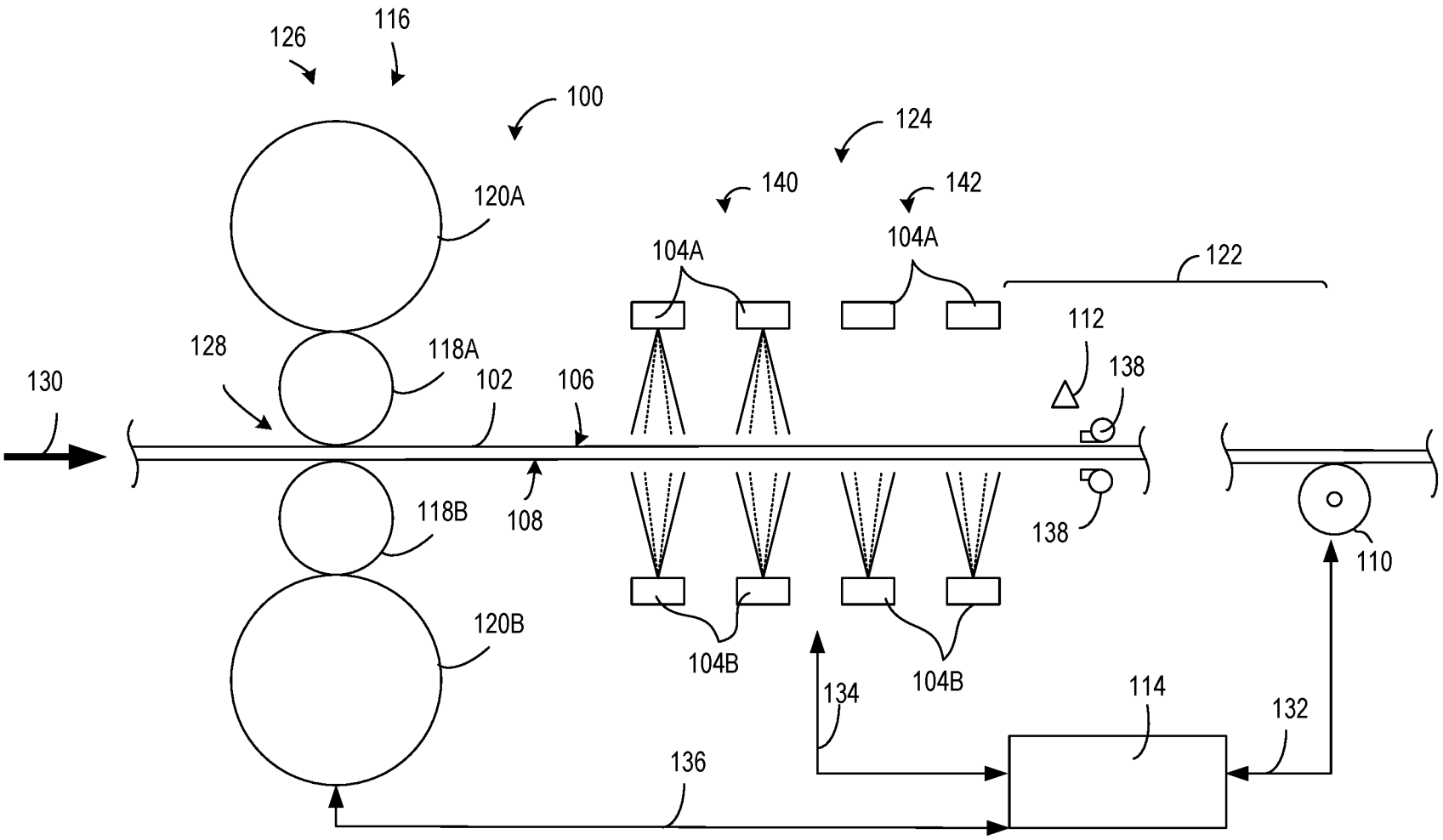
FIG. 1 is a schematic of a system for quenching a rolled metal substrate according to aspects of the present disclosure.

The subject matter of examples of the present invention is described here with specificity to meet statutory requirements, but this description is not necessarily intended to limit the scope of the claims. The claimed subject matter may be embodied in other ways, may include different elements or steps, and may be used in conjunction with other existing or future technologies. This description should not be interpreted as implying any particular order or arrangement among or between various steps or elements except when the order of individual steps or arrangement of elements is explicitly described.

Disclosed are systems and methods for quenching a metal substrate after rolling. Aspects and features of the present disclosure can be used with any suitable metal substrate, and may be especially useful with aluminum or aluminum alloys. Specifically, desirable results can be achieved for alloys such as 1xxx series, 2xxx series, 3xxx series, 4xxx series, 5xxx series, 6xxx series, 7xxx series, or 8xxx series aluminum alloys. For an understanding of the number designation system most commonly used in naming and identifying aluminum and its alloys, see "International Alloy Designations and Chemical Composition Limits for Wrought Aluminum and Wrought Aluminum Alloys" or "Registration Record of Aluminum Association Alloy Designations and Chemical Compositions Limits for Aluminum Alloys in the Form of Castings and Ingot," both published by The Aluminum Association.

In some cases, the systems and methods disclosed herein may be used with non-ferrous materials, including aluminum, aluminum alloys, magnesium, magnesium-based materials, titanium, titanium-based materials, copper, copper-based materials, steel, steel-based materials, bronze, bronze-based materials, brass, brass-based materials, composites, sheets used in composites, or any other suitable metal, non-metal or combination of materials. The article may include monolithic materials, as well as non-monolithic materials such as roll-bonded materials, clad materials, composite materials (such as but not limited to carbon fiber-containing materials), or various other materials. In one non-limiting example, the systems and methods can be used with metal articles such as aluminum metal strips, slabs, shates, plates, or other articles made from aluminum alloys, including aluminum alloys containing iron.

Aspects and features of the present disclosure can be used to rapidly quench a metal substrate during metal processing from an initial temperature to a target temperature. Aspects and features of the present disclosure can also be used to control a flatness of the metal substrate. In some examples, aspects and features of the present disclosure can be used to rapidly quench a metal substrate after rolling of the metal substrate, such as after hot rolling of the metal substrate. In some non-limiting examples where the metal substrate includes aluminum or an aluminum alloy, rapid quenching of the metal substrate may lock in the elements to produce a finished aluminum alloy product with improved properties (e.g., improved strength, high corrosion resistance, high formability, etc.). As one non-limiting example, aspects and features of the present disclosure may be used to rapidly quench a 6xxx series aluminum alloy with solutes such as magnesium (Mg), silicon (Si), copper (Cu), zinc, (Zn), and/or various other solutes after hot rolling.

An example of a quenching system 124 for rapidly quenching a rolled metal substrate 102 is illustrated in FIGS. 1-4. In some examples, the metal substrate 102 is processed by a metal processing system 100 upstream from the quenching system 124. As one non-limiting example, the metal substrate 102 may be rolled by a rolling mill 126 upstream from the quenching system 124. After processing, the metal substrate 102 then passes through the quenching system 124, which distributes a cooling agent on the metal substrate 102 to quench the metal substrate 102 and reduce the temperature of the metal substrate 102. After passing through the quenching system 124, the metal substrate 102 passes through a flatness-measuring device 110, which determines a flatness profile of the metal substrate 102. In some optional examples, the flatness-measuring device 110 provides a flatness signal 132 to a control system 114. Based on the flatness signal 132, the control system 114 may provide a quenching adjustment signal 134 to the quenching system 124 to control, and adjust as needed, the application of the cooling agent. Additionally or alternatively, the control system 114 may provide a rolling adjustment signal 136 to the rolling mill 126 to control, and adjust as needed, the rolling of the metal substrate 102.

Figure 2:
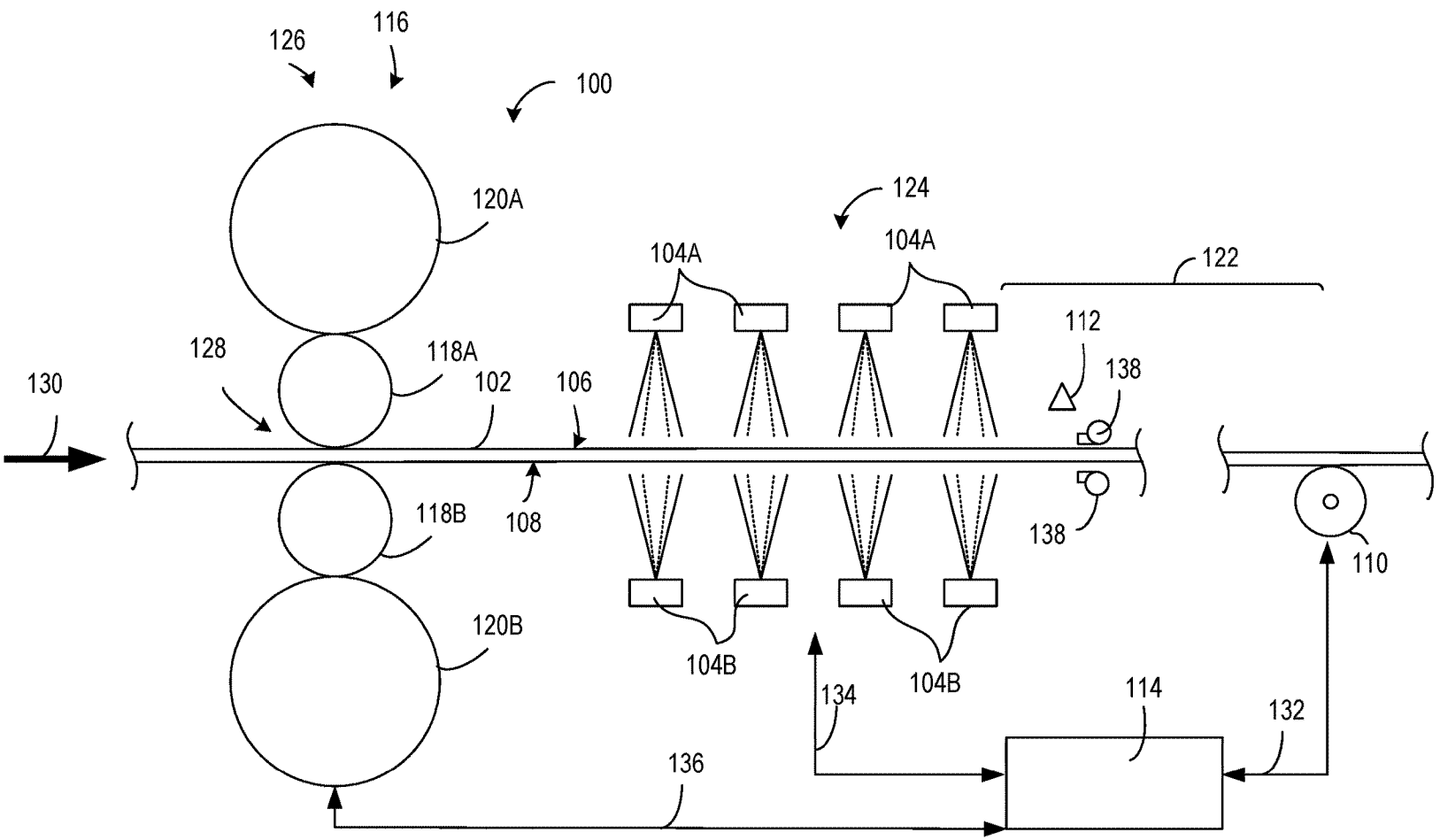
FIG. 2 is another schematic of the system FIG. 1.
Figure 3:
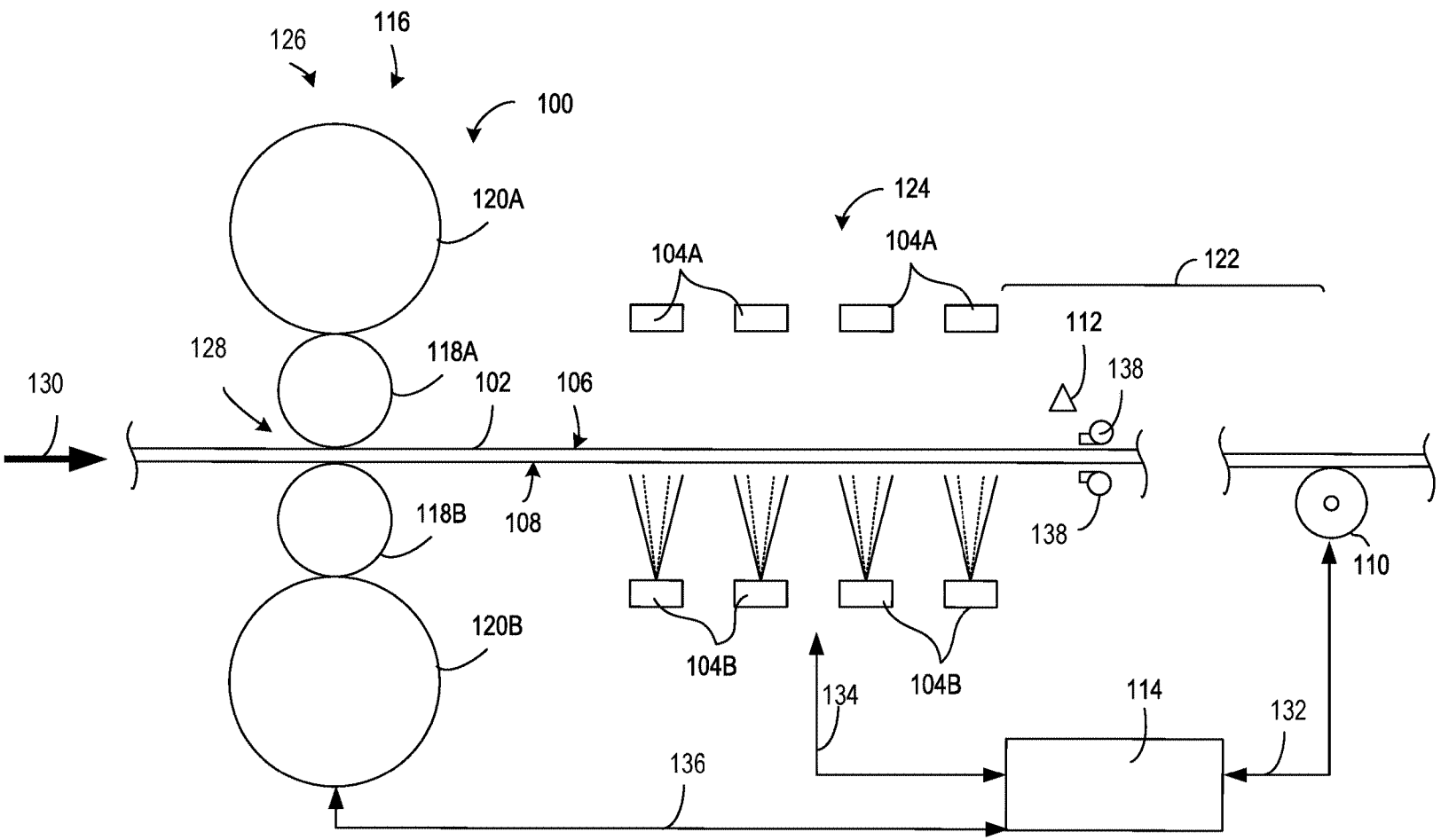
FIG. 3 is another schematic of the system of FIG. 1.

As discussed above, in some examples, the quenching system 124 may be provided with the metal processing system 100 that includes various equipment for processing the metal substrate 102 to a final product. As illustrated in FIGS. 1-3, in some examples, the metal processing system 100 includes at least one work stand 116 of the rolling mill 126. In some examples, the rolling mill 126 includes a plurality of work stands 116, such as two work stands 116, three work stands 116, four work stands 116, or any other desired number of work stands 116. The work stand 116 includes a pair of vertically aligned work rolls 118A-B. In some examples, the work stand 116 also includes backup rolls 120A-B that support the work rolls 118A-B. In various examples, the work stand 116 also includes intermediate rolls. A roll gap 128 is defined between the work rolls 118A-B.

During processing, the metal substrate 102 is moved in a processing direction 130 and is passed through the roll gap 128 such that the work rolls 118A-B reduce the thickness of the metal substrate 102 to a desired thickness and impart particular properties on the metal substrate 102. The particular properties imparted may depend on the composition of the metal substrate 102. In some examples, the rolling mill 126 may be a hot rolling mill that is configured to roll the metal substrate 102 when the temperature of the metal substrate 102 is above the recrystallization temperature of the metal substrate 102. In some non-limiting examples, when the rolling mill 126 is a hot rolling mill, hot rolling of the metal substrate 102 may be performed at a temperature of from about 250° C. to about 500° C. (e.g., from about 300° C. to about 400° C., from about 350° C. to about 500° C., etc.). In other examples, the rolling mill 126 may be a cold rolling mill that is configured to roll the metal substrate 102 when the temperature of the metal substrate 102 is below the recrystallization temperature of the metal substrate 102. In various other examples, the rolling mill 126 may be a warm rolling mill that is configured to roll the metal substrate 102 when the temperature of the metal substrate 102 is below the recrystallization temperature but above the temperature during cold rolling.

In some examples, the quenching system 124 is provided downstream from the rolling mill 126 (or other processing equipment) to quench the metal substrate 102 after rolling (or other processing). As illustrated in FIGS. 1-4, the quenching system 124 includes at least one top nozzle 104A for distributing the cooling agent on a top surface 106 of the metal substrate 102. In the present example, the quenching system 124 includes four top nozzles 104A. However, in various other examples, any number of top nozzles 104A may be provided, such as one top nozzle 104A, two top nozzles 104A, three top nozzles 104A, five top nozzles 104A, or more than five top nozzles 104A. The cooling agent may be any suitable cooling agent or cooling medium capable of sufficiently removing heat from the metal substrate 102 to generate the desired cooling. For example, the cooling agent may be water, an emulsion containing water, a mechanical dispersion containing water, a low-boiling temperature fluid, oil, or various other suitable cooling agents.

The quenching system 124 also includes at least one bottom nozzle 104B for distributing the cooling agent on a bottom surface 108 of the metal substrate 102. In the present example, the quenching system 124 includes four bottom nozzles 104B. However, in various other examples, any number of bottom nozzles 104B may be provided, such as one bottom nozzle 104B, two bottom nozzles 104B, three bottom nozzles 104B, five bottom nozzles 104B, or more than five bottom nozzles 104B. In some examples, the number of bottom nozzles 104B is the same as the number of top nozzles 104A, although it need not be. For example, in other cases, the quenching system 124 may include additional or fewer bottom nozzles 104B compared to the number of top nozzles 104A (see, e.g., FIG. 5).

In various examples, the top nozzles 104A and the bottom nozzles 104B are selectively controllable to cool the metal substrate 102 such that a strip temperature of the metal substrate 102 is reduced from an initial temperature to a target temperature. The initial temperature is the strip temperature when the metal substrate 102 is received by the quenching system 124. In some examples, the initial temperature is the strip temperature of the metal substrate 102 after hot, warm or cold rolling. In certain non-limiting examples, the initial temperature may be greater than about 180° C., such as greater than about 200° C., although it need not be. In some examples, the initial temperature depends on the content of metal substrate 102. The target temperature is the desired strip temperature of the metal substrate 102 after quenching. In certain examples, the target temperature may depend on the strip temperature requirements for additional processing or desired properties of the metal substrate 102. In some non-limiting examples, the target temperature may be from about 60° C. to about 120° C., although various other target temperatures less than the initial temperature may be used.

According to various examples, the top nozzles 104A and the bottom nozzles 104B are selectively controllable such that both the top nozzles 104A and the bottom nozzles 104B distribute the cooling agent to reduce the strip temperature from the initial temperature to an intermediate temperature. In various examples, the intermediate temperature is less than the initial temperature and greater than the target temperature. In some non-limiting examples, the intermediate temperature may be from about 120° C. to about 180° C. In certain examples, the top nozzles 104A and the bottom nozzles 104B are selectively controllable such that the top nozzles 104A stop distributing the cooling agent when the strip temperature reaches the intermediate temperature (and thus stop cooling the metal substrate 102) while the bottom nozzles 104B continue distributing the cooling agent such that the strip temperature is reduced from the intermediate temperature to the target temperature. In various examples, the portion of the quenching system 124 with activated top nozzles 104A and bottom nozzles 104B defines a first quench zone 140, and the portion of the quenching system 124 with only the activated bottom nozzles 104B defines a second quench zone 142.

In various examples, the top nozzles 104A and the bottom nozzles 104B are selectively controllable such that both the top nozzles 104A and the bottom nozzles 104B distribute the cooling agent to reduce the strip temperature from the initial temperature to the intermediate temperature. In certain examples, the top nozzles 104A and the bottom nozzles 104B are selectively controllable such that the bottom nozzles 104B stop distributing the cooling agent when the strip temperature reaches the intermediate temperature (and thus stop cooling the metal substrate 102) while the top nozzles 104A continue distributing the cooling agent such that the strip temperature is reduced from the intermediate temperature to the target temperature. In other words, in certain non-limiting examples, both the top nozzles 104A and bottom nozzles 104B cool the strip to reduce the strip temperature from the initial temperature to the intermediate temperature, and one of the top nozzles 104A or the bottom nozzles 104B are deactivated when the strip temperature reaches the intermediate temperature such that the metal substrate 102 is only cooled from one side (i.e., on the top surface 106 or the bottom surface 108).

Figure 4:
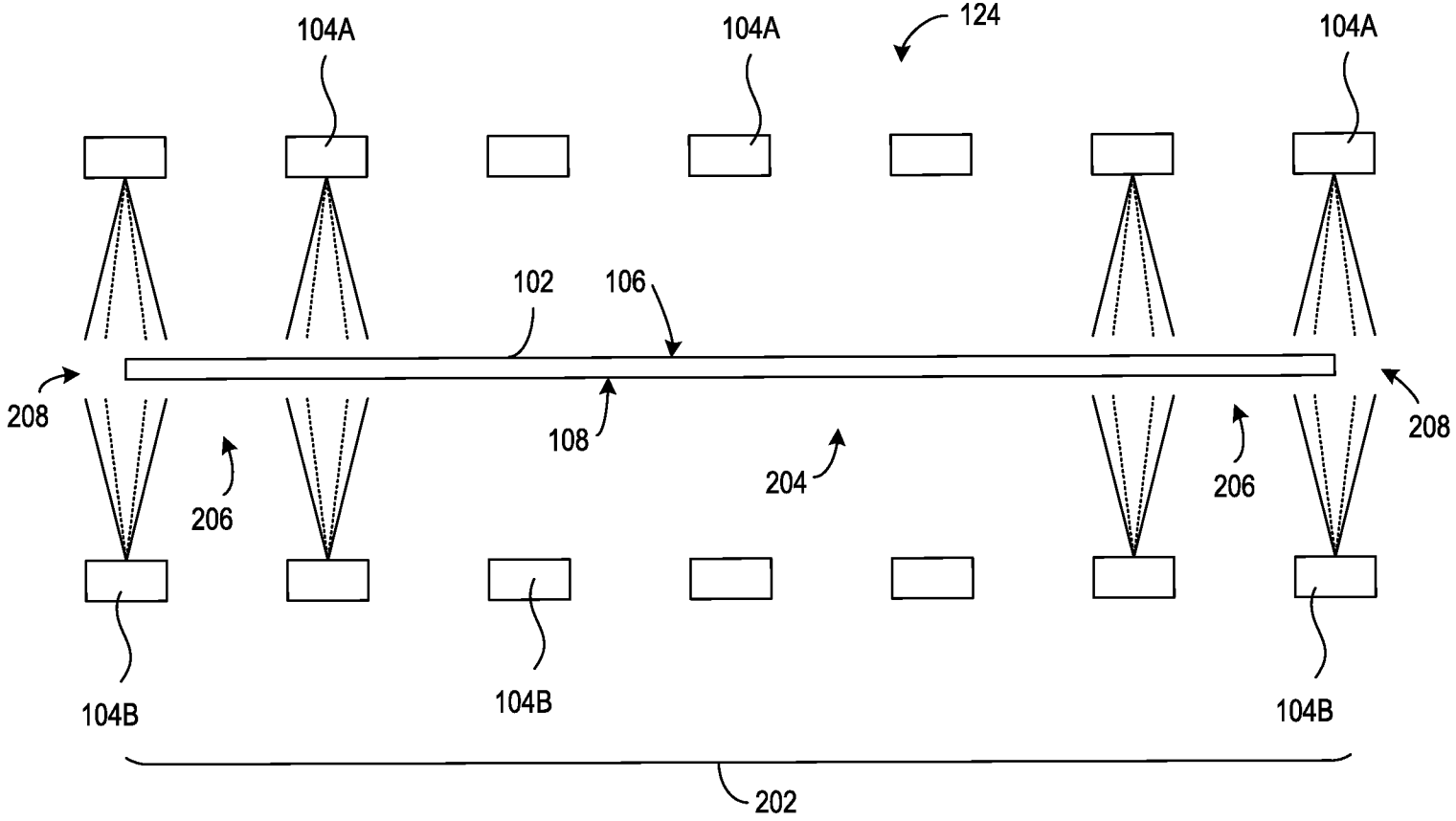
FIG. 4 is another schematic of the system of FIG. 1.

In certain examples, the top nozzles 104A and/or the bottom nozzles 104B may distribute the cooling agent across a width 202 (see FIG. 4) of the metal substrate 102 to uniformly cool the metal substrate 102 across the width 202. In other examples, as illustrated in FIG. 4, the top nozzles 104A and/or the bottom nozzles 104B may distribute the cooling agent across the width 202 of the metal substrate 102 to generate differential cooling, meaning that some portions of the metal substrate 102 may be cooled more than other portions of the metal substrate 102. In various examples, some of the top nozzles 104A may provide uniform cooling across the width 202 and other top nozzles 104A may provide differential cooling. Likewise, in some examples, some of the bottom nozzles 104B may provide uniform cooling across the width 202 and other bottom nozzles 104B may provide differential cooling. In various examples, the amount and application of the cooling agent to particular locations along the width 202 of the metal substrate 102 can be adjusted based on a desired flatness profile.

FIG. 4 illustrates one non-limiting example of differential cooling where selected portions 206 of the metal substrate 102 are cooled and unselected portions 204 are not cooled or receive less cooling agent compared to the selected portions 206. In certain examples, the selected portions 206 may be portions of the metal substrate 102 where the strip tension is the highest. As one non-limiting example, strip tension may be highest at edges 208 of the metal substrate 102. The more localized the stress, the less differential cooling may be required to achieve the desired improved flatness. In some cases, a relatively small amount of cooling can be applied to the edges 208 of the metal substrate 102, which can remove or reduce significant center buckles and/or distortion from the metal substrate 102. Unselected portions 204 can be portions where the strip tension is lower, such as the middle of the metal substrate 102 between the edges 208. Differential cooling includes any difference in temperature applied across the width 202 of the metal substrate 102. In some examples, the selected portion 206 (e.g., an edge 208) along the width 202 of the metal substrate 102 can be subjected to cooling while the unselected portion 204 (e.g., the middle of the metal substrate 102) along the width 202 of the metal substrate 102 is not subjected to any cooling. In other examples, a selected portion 206 (e.g., an edge 208) along the width 202 of the metal substrate 102 can be subjected to greater cooling than the cooling provided to the unselected portion 204 (e.g., the middle of the metal substrate 102) along the width 202 of the metal substrate 102.

Application of differential (also referred to as non-uniform, preferential, or selective) cooling to the selected portions 206 of the width 202 of a metal substrate 102 can cause the selected portions 206 to thermally contract, increasing the tension along the selected portions 206. Differential cooling can cause a temporary temperature gradient along the metal substrate 102 where the selected portions 206 of the width 202 of the metal substrate 102 (e.g., the edges 208) are cooler than the unselected portions 204 (e.g., the middle).

In the non-limiting example of FIG. 4 where cooling is applied to the edges 208 of the metal substrate 102 to generate the temperature gradient, the tension at the edges 208 of the metal substrate 102 can be temporarily increased, compared to the warmer, unselected portion 204 (e.g., middle) of the metal substrate 102. Because the temperature along the width 202 of the metal substrate 102 is not uniform, differential tension exists along the width 202 of the metal substrate 102. If this imposed tension distribution is not equalized soon after being applied (e.g., by intervening support rolls, or otherwise), and the metal substrate 102 is sufficiently hot to yield slightly under the differential tension, the differential temperature imparted by the differential cooling can cause the metal substrate 102 to lengthen slightly along the colder portion of the width 202 (e.g., the selected portions 206) of the metal substrate 102. Yield, as used herein, can be considered a permanent strain or elongation of the metal substrate 102, which partially relieves the applied stress (e.g., from the imposed tension distribution). The stress required to cause permanent strain decreases as the metal substrate 102 temperature increases. As used herein with reference to metal substrate 102, yield includes permanent strain at conventionally accepted yield stress levels, as well as at stress levels below the conventionally accepted yield stress levels, such as the permanent strain that can occur from rapid creep. Therefore, for a metal substrate 102 to yield, as the term is used herein, it is not necessary to induce differential tension that provides stress levels at or above the conventionally accepted yield stress of the metal substrate 102.

Regardless of whether or not the actual temperature gradient imposed on the metal substrate 102 is known, the temperature gradient is based on the differential cooling, which can be based on various factors, such as models, flatness measurements, or other factors, as disclosed herein. Differential cooling of the edges 208 of a metal substrate 102 causes a local concentration of tensile stress sufficient to put the metal substrate 102 into yield and stretch the edges 208, correcting any center waves or distortion present in the metal substrate 102. In this way, the flatness of the metal substrate 102 can be adjusted and/or improved using differential cooling. When active differential cooling of the metal substrate 102 is discontinued, the temperature profile of the metal substrate 102 across its width 202 will eventually equalize, but any changes due to yield will remain, and therefore the improved flatness will be maintained. As described below, in certain examples, the flatness-measuring device 110 is positioned a predetermined distance 122 downstream from the quenching system 124 that is sufficient for the temperature profile to equalize.

As illustrated in FIGS. 1-3, in certain examples, a sensor 112 may be provided to detect the strip temperature. The location or number of sensors 112 should not be considered limiting on the current disclosure.

In some examples, a coolant removal device 138 or other coolant containment system may be provided. In various examples, the coolant removal device 138 may be provided for removing the cooling agent off the top surface 106 of the metal substrate 102, the bottom surface 108 of the metal substrate 102, or both the top surface 106 and the bottom surface 108 of the metal substrate 102. As such, the number and location of the coolant removal devices 138 should not be considered limiting on the current disclosure. In various examples, the coolant removal device 138 may be any device suitable for removing the cooling agent off the metal substrate 102 including, but not limited to, a blower, a wiper, a flexible seal, or various other suitable devices. In one non-limiting example, the coolant removal device 138 is a blower that is an air knife. As described below, in various aspects, the coolant removal device 138 may be activated when the top nozzles 104A stop distributing the cooling agent on the metal substrate (i.e., when the strip temperature reaches the intermediate temperature) to remove residual cooling agent off the top surface 106 of the metal substrate 102.

In various examples, the flatness-measuring device 110 is provided to measure the flatness profile of the metal substrate 102. In some non-limiting examples, the flatness-measuring device 110 is a shape roll, although various other suitable devices for detecting the flatness profile of the metal substrate 102 may be used. The flatness-measuring device 110 is positioned the predetermined distance 122 downstream from the quenching system 124. The predetermined distance 122 between the flatness-measuring device 110 and the quenching system 124 is a distance that allows for a temperature profile across the width 202 of the metal substrate 102 to equalize. In some cases, by providing the predetermined distance 122 before measuring the flatness profile with the flatness-measuring device, a more accurate shape measurement (e.g., flatness profile) may be obtained because temperature variations across the width 202 (which would otherwise cause inaccurate measurements) are minimized or reduced. In certain examples, at least one aspect of the quenching system 124 is adjustable or controllable based on the measured flatness profile. In some non-limiting examples, the at least one aspect of the quenching system 124 may include a number of activated top nozzles 104A and/or the bottom nozzles 104B, the cooling profile of the top nozzles 104A and/or the bottom nozzles 104B, an amount of cooling agent distributed by the top nozzles 104A and/or the bottom nozzles 104B, and/or various other adjustable aspects of the quenching system 124. In some examples, at least one aspect of the rolling mill 126 is controllable or adjustable based on the measured flatness profile including, but not limited to, a size of the roll gap 128, a contact pressure distribution of the work rolls 118A-B on the metal substrate 102, and/or various other adjustable aspects of the rolling mill 126.

Optionally, the control system 114 is provided. As illustrated in FIGS. 1-3, the control system 114 may be in communication with the flatness-measuring device 110 and the quenching system 124. In some optional cases, the control system 114 is also in communication with the work stand 116. The control system 114 is configured to receive the flatness profile measured by the flatness-measuring device 110 as part of the flatness signal 132. The control system 114 is further configured to compare the measured flatness profile to a predetermined flatness profile. Based on the comparison of the measured flatness profile to the predetermined flatness profile, the control system 114 may control, and adjust as needed, the quenching system 124 and/or the work stand 116 such that the measured flatness profile matches the predetermined flatness profile. As one non-limiting example, FIG. 2 illustrates a case where additional rapid quenching is needed (e.g., because the strip temperature is too high), and additional top nozzles 104A are activated. As another non-limiting example, FIG. 3 illustrates a case where less quenching is needed (e.g., because the strip temperature is sufficiently low), and additional top nozzles 104A are deactivated.

Figure 5:
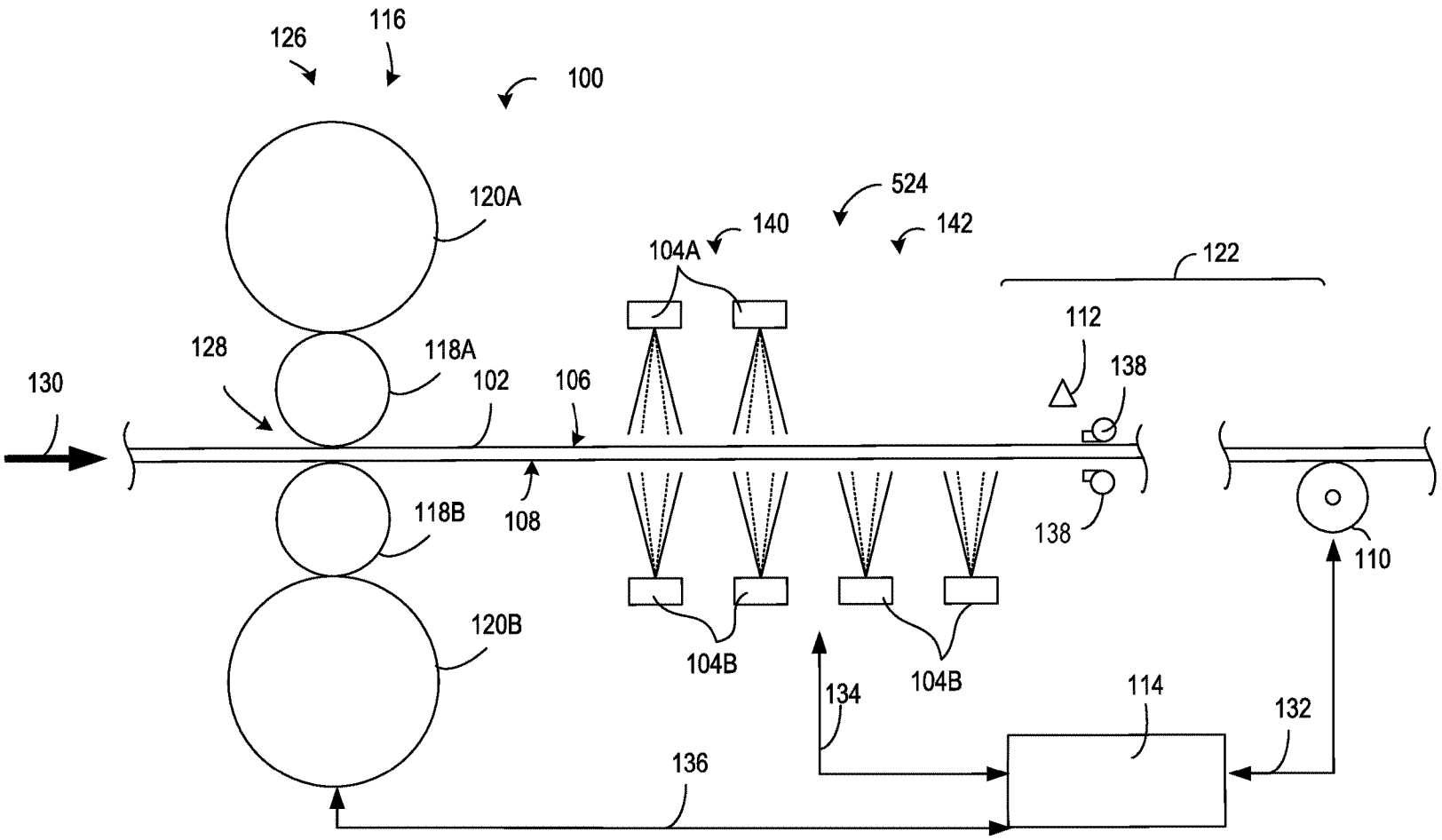
FIG. 5 is a schematic of a system for quenching a rolled metal substrate according to aspects of the present disclosure.

FIG. 5 illustrates an example of a quenching system 524 that is substantially similar to the quenching system 124 except that the second quench zone 142 only includes the bottom nozzles 104B.

A method of processing the metal substrate 102 is also provided. In various examples, the method includes receiving the metal substrate 102 having the strip temperature at the initial strip temperature at the quenching system 124. In some examples, the method includes rolling the metal substrate 102 with the rolling mill 126 prior to receiving the metal substrate 102 at the quenching system 124. In one non-limiting example, the method includes hot rolling the metal substrate 102 before receiving the metal substrate 102 at the quenching system 124.

The method includes quenching the metal substrate 102 with the quenching system 124. Quenching includes cooling the top surface 106 and the bottom surface 108 of the metal substrate 102 with the quenching system 124 such that the strip temperature is reduced from the initial temperature to the intermediate temperature. In some aspects, cooling the top surface 106 includes distributing the cooling agent on the top surface 106 with at least one top nozzle 104A, and cooling the bottom surface 108 includes distributing the cooling agent on the bottom surface 108 with at least one bottom nozzle 104B.

In various aspects, the method includes detecting the strip temperature of the metal substrate 102 with the sensor 112. In some examples, quenching includes using the top nozzles 104A to distribute the cooling agent onto the top surface 106 of the metal substrate 102 until a strip temperature of the metal substrate is reduced from an initial temperature to an intermediate temperature. In various examples, the quenching includes using the bottom nozzles 104B to distribute the cooling agent on the bottom surface 108 until the strip temperature of the metal substrate is reduced from the initial temperature to a target temperature, which is less than the intermediate temperature. In other words, quenching the metal substrate 102 with the quenching system 124 includes cooling both the top surface 106 and the bottom surface 108 of the metal substrate 102 until the strip temperature is reduced from the initial temperature to the intermediate temperature and stopping the cooling of the top surface 106 while continuing the cooling of the bottom surface 108 such that the strip temperature is reduced from the intermediate temperature to the target temperature. In certain aspects, the method includes deactivating the quenching system 124 such that the quenching system 124 stops cooling the metal substrate 102 when the strip temperature is at or below the target temperature.

According to various examples, cooling the top surface 106 may include cooling the selected portion 206 of the width 202 of the metal substrate 102 more than the unselected portion 204 of the width 202 of the metal substrate 102 with the top nozzles 104A. Similarly, in additional or alternative cases, cooling the bottom surface 108 may include cooling the selected portion 206 of the width 202 of the metal substrate 102 more than the unselected portion 204 of the width 202 of the metal substrate 102 with the bottom nozzles 104B. In various cases, the selected portion 206 is edges 208 of the metal substrate 102 and the unselected portion 204 is a non-edge portion (e.g., middle) of the metal substrate 102.

In various cases, the method includes blowing residual cooling agent off the top surface 106 of the metal substrate 102 when the cooling of the top surface 106 is stopped. In some aspects, the method includes blowing residual cooling agent off the top surface 106 of the metal substrate 102 when the strip temperature reaches the intermediate temperature. In certain cases, the method includes blowing residual cooling agent off the top surface 106 of the metal substrate 102 while continuing the cooling of the bottom surface 108 of the metal substrate 102.

According to certain examples, the method includes passing the metal substrate 102 from the quenching system 124 to the flatness-measuring device 110 after the predetermined distance 122. In certain examples, passing the metal substrate 102 after the predetermined distance includes allowing a temperature profile across the width 202 of the metal substrate 102 to equalize. In various examples, passing the metal substrate 102 after the predetermined distance includes drying the bottom surface 108 of the metal substrate 102, which may be blowing the bottom surface 108 or otherwise.

In some examples, the method includes measuring the flatness profile of the metal substrate 102 across the width 202 of the metal substrate 102 with the flatness-measuring device 110. Optionally, the method includes controlling at least one aspect of the quenching system 124 based on the measured flatness profile. In certain cases, the method includes receiving the flatness signal 132 at the control system 114 from the flatness-measuring device 110, comparing the measured flatness profile to the predetermined flatness profile, and controlling at least one aspect of the quenching system 124 such that the measured flatness profile matches the predetermined flatness profile. Additionally or alternatively, the method includes controlling at least one aspect of the work stand 116 of the rolling mill 126 such that the measured flatness profile matches the predetermined flatness profile.

A collection of exemplary embodiments, including at least some explicitly enumerated as "ECs" (Example Combinations), providing additional description of a variety of embodiment types in accordance with the concepts described herein are provided below. These examples are not meant to be mutually exclusive, exhaustive, or restrictive; and the invention is not limited to these example embodiments but rather encompasses all possible modifications and variations within the scope of the issued claims and their equivalents.

EC 1. A system for processing a rolled metal substrate comprising: a quenching system comprising: a top nozzle configured to distribute a cooling agent on a top surface of the rolled metal substrate; and a bottom nozzle configured to distribute the cooling agent on a bottom surface of the rolled metal substrate, wherein the top nozzle is configured to distribute the cooling agent until a strip temperature of the rolled metal substrate is reduced from an initial temperature to an intermediate temperature that is less than the initial temperature, and wherein the bottom nozzle is configured to distribute the cooling agent until the strip temperature of the rolled metal substrate is reduced from the initial temperature to a target temperature that is less than the initial temperature and less than the intermediate temperature.

EC 2. The system of any of the preceding or subsequent example combinations, wherein the quenching system comprises a plurality of top nozzles and a plurality of bottom nozzles.

EC 3. The system of any of the preceding or subsequent example combinations, wherein the quenching system is configured to cool a selected portion of a width of the rolled metal substrate more than an unselected portion of the width of the metal substrate.

EC 4. The system of any of the preceding or subsequent example combinations, wherein the selected portion is an edge of the metal substrate and the unselected portion is a non-edge portion of the metal substrate.

EC 5. The system of any of the preceding or subsequent example combinations, wherein the intermediate temperature is from about 120° C. to about 180° C.

EC 6. The system of any of the preceding or subsequent example combinations, wherein the target temperature is from about 60° C. to about 120° C.

EC 7. The system of any of the preceding or subsequent example combinations, wherein the initial temperature is greater than about 180° C.

EC 8. The system of any of the preceding or subsequent example combinations, wherein the initial temperature is greater than about 200° C.

EC 9. The system of any of the preceding or subsequent example combinations, further comprising a coolant removal device configured to remove the cooling agent off the top surface, bottom surface, or both the top and bottom surface of the metal substrate when the top nozzle is deactivated, wherein the coolant removal device is a blower, and wherein the blower comprises an air knife.

EC 10. The system of any of the preceding or subsequent example combinations, further comprising at least one sensor configured to detect the strip temperature.

EC 11. The system of any of the preceding or subsequent example combinations, further comprising a flatness-measuring device a predetermined distance downstream from the quenching system, wherein the flatness-measuring device is configured to: measure a flatness profile of the metal substrate across a width of the metal substrate; and output the measured flatness profile in a flatness signal.

EC 12. The system of any of the preceding or subsequent example combinations, wherein the predetermined distance is a distance sufficient for the strip temperature to equilibrate.

EC 13. The system of any of the preceding or subsequent example combinations, wherein the quenching system is adjustable based on the flatness signal.

EC 14. The system of any of the preceding or subsequent example combinations, further comprising a controller configured to: receive the flatness signal from the flatness-measuring device; compare the measured flatness profile to a predetermined flatness profile; and control the quenching system such that the measured flatness profile matches the predetermined flatness profile.

EC 15. The system of any of the preceding or subsequent example combinations, further comprising a work stand of a rolling mill comprising a pair of work rolls, wherein the work rolls are adjustable based on the flatness signal.

EC 16. The system of any of the preceding or subsequent example combinations, further comprising a controller configured to: receive the flatness signal from the flatness-measuring device; compare the measured flatness profile to a predetermined flatness profile; and control the work rolls of the work stand such that the measured flatness profile matches the predetermined flatness profile.

EC 17. The system of any of the preceding or subsequent example combinations, wherein the flatness-measuring device comprises a shape roll.

EC 18. A method of processing a rolled metal substrate comprising: cooling a top surface and a bottom surface of the rolled metal substrate with a quenching system such that a strip temperature of the rolled metal substrate is reduced from an initial temperature to an intermediate temperature; stopping the cooling of the top surface when the strip temperature is the intermediate temperature; and continue cooling the bottom surface of the rolled metal substrate with the quenching system such that the strip temperature of the rolled metal substrate is reduced from the intermediate temperature to a target temperature.

EC 19. The method of any of the preceding or subsequent example combinations, wherein the quenching system comprises a top nozzle and a bottom nozzle, wherein cooling the top surface of the rolled metal substrate comprises distributing a cooling agent on the top surface with the top nozzle, and wherein cooling the bottom surface of the rolled metal substrate comprises distributing the cooling agent on the bottom surface with the bottom nozzle.

EC 20. The method of any of the preceding or subsequent example combinations, wherein the quenching system comprises a plurality of top nozzles and a plurality of bottom nozzles, wherein cooling the top surface of the rolled metal substrate comprises distributing a cooling agent on the top surface with the plurality of top nozzles, and wherein cooling the bottom surface of the rolled metal substrate comprises distributing the cooling agent on the bottom surface with the plurality of bottom nozzles.

EC 21. The method of any of the preceding or subsequent example combinations, wherein cooling the top surface comprises cooling a selected portion of a width of the rolled metal substrate more than an unselected portion of the width of the metal substrate.

EC 22. The method of any of the preceding or subsequent example combinations, wherein the selected portion is an edge of the metal substrate and the unselected portion is a non-edge portion of the metal substrate.

EC 23. The method of any of the preceding or subsequent example combinations, wherein cooling the bottom surface comprises cooling a selected portion of a width of the rolled metal substrate more than an unselected portion of the width of the metal substrate.

EC 24. The method of any of the preceding or subsequent example combinations, wherein the selected portion is an edge of the metal substrate and the unselected portion is a non-edge portion of the metal substrate.

EC 25. The method of any of the preceding or subsequent example combinations, wherein the first temperature is from about 120° C. to about 180° C.

EC 26. The method of any of the preceding or subsequent example combinations, wherein the second temperature is from about 60° C. to about 120° C.

EC 27. The method of any of the preceding or subsequent example combinations, further comprising blowing the cooling agent off of the top surface of the metal substrate after stopping the cooling of the top surface.

EC 28. The method of any of the preceding or subsequent example combinations, further comprising measuring a flatness profile of the metal strip across a width of the metal substrate with a flatness-measuring device.

EC 29. The method of any of the preceding or subsequent example combinations, wherein the flatness-measuring device is a predetermined distance downstream from the quenching system, and wherein the method further comprises passing the metal substrate over the predetermined distance such that a temperature profile of the strip temperature is at equilibrium, i.e., where a temperature of the selected portion and a temperature of the non-selected portions are substantially equal.

EC 30. The method of any of the preceding or subsequent example combinations, further comprising controlling at least one aspect of the quenching system based on the measured flatness profile.

EC 31. The method of any of the preceding or subsequent example combinations, further comprising: receiving a flatness signal with the measured flatness profile at a controller; comparing the measured flatness profile to a predetermined flatness profile; and controlling the at least one aspect of the quenching system such that the measured flatness profile matches the predetermined flatness profile.

EC 32. The method of any of the preceding or subsequent example combinations, further comprising: receiving a flatness signal with the measured flatness profile at a controller; comparing the measured flatness profile to a predetermined flatness profile; and controlling at least one aspect of a work stand of a rolling mill such that the measured flatness profile matches the predetermined flatness profile.

EC 33. A system for processing a rolled metal substrate comprising: a quenching system configured to selectively distribute a cooling agent on the metal substrate in a first quenching configuration and a second quenching configuration, wherein the quenching system cools a top surface and a bottom surface of the metal strip in the first quenching configuration, and wherein the quenching system cools only the bottom surface of the metal strip in the second quenching configuration; and a sensor configured to detect a strip temperature of the metal substrate, wherein the quenching system is in the first quenching configuration when the strip temperature is at least an intermediate temperature, and wherein the quenching system is in the second quenching configuration when the strip temperature is from the intermediate temperature to the a target temperature that is less than the intermediate temperature.

EC 34. The system of any of the preceding or subsequent example combinations, wherein the intermediate temperature is from about 120° C. to about 180° C., and wherein the target temperature is from about 60° C. to about 120° C.

EC 35. The system of any of the preceding or subsequent example combinations, wherein the quenching system comprises a plurality of top nozzles configured to distribute the cooling agent on the top surface of the metal substrate and a plurality of bottom nozzles configured to distribute the cooling agent on the bottom surface of the metal substrate.

EC 36. The system of any of the preceding or subsequent example combinations, wherein the quenching system is further configured to cool a selected portion of a width of the rolled metal substrate more than an unselected portion of the width of the metal substrate.

EC 37. The system of any of the preceding or subsequent example combinations, wherein the quenching system is downstream from a work stand of a rolling mill.

EC 38. The system of any of the preceding or subsequent example combinations, further comprising a flatness-measuring device configured to measure a flatness profile of the metal substrate across a width of the metal substrate.

EC 39. The system of any of the preceding or subsequent example combinations, further comprising a controller configured to: receive a flatness signal comprising the measured flatness profile; compare the measured flatness profile to a predetermined flatness profile; and control the quenching system or a work stand of a rolling mill such that the measured flatness profile matches the predetermined flatness profile.

EC 40. A method of processing a rolled metal substrate comprising: detecting a strip temperature of the rolled metal substrate; cooling a top surface and a bottom surface of the rolled metal substrate with a quenching system when the strip temperature is at least an intermediate temperature; cooling only the bottom surface of the rolled metal substrate with the quenching system when the strip temperature is from the intermediate temperature to a target temperature that is less than the intermediate temperature.

EC 41. The method of any of the preceding or subsequent example combinations, further comprising deactivating the quenching system such that the quenching system stops cooling the metal substrate when the strip temperature is the target temperature.

EC 42. The method of any of the preceding or subsequent example combinations, wherein cooling the top surface and the bottom surface of the rolled metal substrate comprises cooling a selected portion of a width of the rolled metal substrate more than an unselected portion of the width of the metal substrate.

EC 43. The method of any of the preceding or subsequent example combinations, wherein cooling only the bottom surface of the rolled metal substrate comprises cooling a selected portion of a width of the rolled metal substrate more than an unselected portion of the width of the metal substrate.

EC 44. The method of any of the preceding or subsequent example combinations, further comprising passing the metal substrate a predetermined distance from the quenching system such that the strip temperature equilibrates; and measuring a flatness profile of the metal substrate.

EC 45. The method of any of the preceding or subsequent example combinations, further comprising: receiving the measured flatness profile of the metal substrate; comparing the measured flatness profile with a predetermined flatness profile; and controlling at least one of the quenching system or a work stand of a rolling mill such that the measured flatness profile matches the predetermined flatness profile.

EC 46. A system for processing a rolled metal substrate comprising: a quenching system comprising: at least one top nozzle configured to distribute a cooling agent on a top surface of the rolled metal substrate; at least two bottom nozzles configured to distribute the cooling agent on a bottom surface of the rolled metal substrate; a first quench zone comprising the at least one top nozzle and a first bottom nozzle of the at least two bottom nozzles; and a second quench zone downstream from the first quench zone and comprising a second bottom nozzle of the at least two bottom nozzles.

EC 47. The system of any of the preceding or subsequent example combinations, wherein the first quench zone is configured to cool the metal substrate until a strip temperature of the metal substrate is reduced from an initial temperature to an intermediate temperature, and wherein the second quench zone is configured to cool the metal substrate until the strip temperature is reduced from the intermediate temperature to a target temperature.

EC 48. The system of any of the preceding or subsequent example combinations, further comprising a flatness-measuring device configured to measure a flatness profile of the metal substrate across a width of the metal substrate downstream from the second quench zone.

EC 49. The system of any of the preceding or subsequent example combinations, further comprising a controller configured to: receive a flatness signal comprising the measured flatness profile; compare the measured flatness profile to a predetermined flatness profile; and control the quenching system or a work stand of a rolling mill such that the measured flatness profile matches the predetermined flatness profile.

EC 50. The system of any of the preceding or subsequent example combinations, wherein the first quench zone is configured to cool a selected portion of a width of the rolled metal substrate more than an unselected portion of the width of the metal substrate.

EC 51. The system of any of the preceding or subsequent example combinations, wherein the second quench zone is configured to cool a selected portion of a width of the rolled metal substrate more than an unselected portion of the width of the metal substrate.

EC 52. The system of any of the preceding or subsequent example combinations, further comprising a coolant removal device configured to remove the cooling agent off the top surface, bottom surface, or both the top and bottom surface of the metal substrate when the top nozzle is deactivated, wherein the coolant removal device is a blower, and wherein the blower comprises an air knife.

The above-described aspects are merely possible examples of implementations, merely set forth for a clear understanding of the principles of the present disclosure. Many variations and modifications can be made to the above-described example(s) without departing substantially from the spirit and principles of the present disclosure. All such modifications and variations are included herein within the scope of the present disclosure, and all possible claims to individual aspects or combinations of elements or steps are intended to be supported by the present disclosure. Moreover, although specific terms are employed herein, as well as in the claims that follow, they are used only in a generic and descriptive sense, and not for the purposes of limiting the described invention, nor the claims that follow.

That which is claimed is:

1. A system for processing a metal substrate comprising:
a piece of processing equipment;
a control system;
a quenching system downstream from the piece of processing equipment and configured to receive the metal substrate moving in a processing direction from the piece of processing equipment, the quenching system comprising:
a top nozzle configured to distribute a cooling agent on a top surface of the metal substrate while the metal substrate is moving in the processing direction; and
a bottom nozzle configured to distribute the cooling agent on a bottom surface of the metal substrate while the metal substrate is moving in the processing direction,
wherein the quenching system is communicatively coupled with the control system; and
a flatness measuring device a predetermined distance downstream from the quenching system, wherein the flatness measuring device is communicatively coupled with the control system and is configured to measure a flatness profile of the metal substrate and output the measured flatness profile in a flatness signal,
wherein the control system is configured to control the top nozzle to distribute the cooling agent until a strip temperature of the metal substrate is reduced from an initial temperature to an intermediate temperature that is less than the initial temperature and based on the flatness signal, and
wherein the control system is configured to control the bottom nozzle to distribute the cooling agent until the strip temperature of the metal substrate is reduced from the initial temperature to a target temperature that is less than the initial temperature and less than the intermediate temperature and based on the flatness signal.

2. The system of claim 1, wherein the quenching system comprises a plurality of top nozzles and a plurality of bottom nozzles.

3. The system of claim 1, wherein the quenching system is configured to cool a selected portion of a width of the metal substrate more than an unselected portion of the width of the metal substrate.

4. The system of claim 3, wherein the selected portion is an edge of the metal substrate and the unselected portion is a non-edge portion of the metal substrate.

5. The system of claim 1, wherein the intermediate temperature is from about 120° C. to about 180° C., wherein the target temperature is from about 60° C. to about 120° C., and wherein the initial temperature is greater than about 180° C.

6. The system of claim 1, wherein the control system is further configured to:
receive the flatness signal from the flatness-measuring device;
compare the measured flatness profile to a predetermined flatness profile; and
control the quenching system such that the measured flatness profile matches the predetermined flatness profile.

7. A method of processing a metal substrate comprising:
receiving the metal substrate moving in a processing direction from a rolling mill;
cooling a top surface and a bottom surface of the metal substrate with a quenching system while the metal substrate is moving in the processing direction such that a strip temperature of the metal substrate is reduced from an initial temperature to an intermediate temperature;

measuring a flatness profile across a width of the metal substrate with a flatness measuring device a predetermined distance downstream from the quenching system, and outputting the measured flatness profile in a flatness signal to a control system;

controlling, by the control system, the quenching system by stopping the cooling of the top surface when the strip temperature is the intermediate temperature while the metal substrate is moving in the processing direction, and based on the flatness signal; and controlling, by the control system, the quenching system by continuing the cooling of the bottom surface of the metal substrate with the quenching system while the metal substrate is moving in the processing direction until the strip temperature of the metal substrate is reduced from the intermediate temperature to a target temperature and based on the flatness signal.

8. The method of claim 7, wherein the quenching system comprises at least one top nozzle and at least one bottom nozzle, wherein cooling the top surface of the metal substrate comprises distributing a cooling agent on the top surface with the at least one top nozzle, and wherein cooling the bottom surface of the metal substrate comprises distributing the cooling agent on the bottom surface with the at least one bottom nozzle.

9. The method of claim 7, wherein cooling the top surface comprises cooling a selected portion of a width of the metal substrate more than an unselected portion of the width of the metal substrate.

10. The method of claim 7, wherein cooling the bottom surface comprises cooling a selected portion of a width of the metal substrate more than an unselected portion of the width of the metal substrate.

11. The method of claim 7, wherein the intermediate temperature is from about 120° C. to about 180° C., and wherein the target temperature is from about 60° C. to about 120° C.

12. The method of claim 7, further comprising:

comparing the measured flatness profile to a predetermined flatness profile; and controlling the at least one aspect of the quenching system such that the measured flatness profile matches the predetermined flatness profile.

13. A system for processing a metal substrate comprising:

a quenching system configured to receive the metal substrate moving in a processing direction and selectively distribute a cooling agent on the metal substrate in a first quenching configuration and a second quenching configuration while the metal substrate is moving in the processing direction, wherein the quenching system cools a top surface and a bottom surface of the metal substrate in the first quenching configuration, and wherein the quenching system cools only the bottom surface of the metal substrate in the second quenching configuration;

a flatness measuring device a predetermined distance downstream from the quenching system, wherein the flatness measuring device is communicatively coupled with the control system and is configured to measure a flatness profile of the metal substrate across a width of the metal substrate and output the measured flatness profile in a flatness signal;

a sensor configured to detect a strip temperature of the metal substrate while the metal substrate is moving in the processing direction and output the detected strip temperature as a temperature signal; and a control system, wherein the control system is configured to control the quenching system to be in the first quenching configuration based on the temperature signal indicating that the strip temperature is at least an intermediate temperature and based on the flatness signal, and wherein the control system is configured to control the quenching system to be in the second quenching configuration based on the temperature signal indicating that the strip temperature is reducing from the intermediate temperature to a target temperature that is less than the intermediate temperature and based on the flatness signal.

14. The system of claim 13, wherein the intermediate temperature is from about 120° C. to about 180° C., and wherein the target temperature is from about 60° C. to about 120° C.

15. The system of claim 13, wherein the quenching system comprises a plurality of top nozzles configured to distribute the cooling agent on the top surface of the metal substrate and a plurality of bottom nozzles configured to distribute the cooling agent on the bottom surface of the metal substrate.

16. The system of claim 13, wherein the quenching system is further configured to cool a selected portion of a width of the metal substrate more than an unselected portion of the width of the metal substrate.

17. The system of claim 13, wherein the quenching system is downstream from a work stand of a rolling mill.

* * * * *